US008777139B2

(12) United States Patent
Yagome

(10) Patent No.: US 8,777,139 B2
(45) Date of Patent: Jul. 15, 2014

(54) PULVERIZER, PULVERIZATION METHOD, TONER PRODUCTION METHOD, AND TONER

(75) Inventor: Keisuke Yagome, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 64 days.

(21) Appl. No.: 13/556,413

(22) Filed: Jul. 24, 2012

(65) Prior Publication Data

US 2013/0034808 A1 Feb. 7, 2013

(30) Foreign Application Priority Data

Aug. 5, 2011 (JP) ..... 2011-172216

(51) Int. Cl.
*B02C 19/06* (2006.01)

(52) U.S. Cl.
USPC ..... 241/40

(58) Field of Classification Search
CPC ..... B02C 19/066
USPC ..... 241/5, 39, 40, 81
See application file for complete search history.

(56) References Cited

U.S. PATENT DOCUMENTS 4,089,472 A * 5/1978 Siegel et al. ..... 241/5
5,839,670 A * 11/1998 Omata et al. ..... 241/5
6,138,931 A * 10/2000 Geurts et al. ..... 241/40
2004/0251330 A1 12/2004 Takahashi et al.
2005/0003294 A1 1/2005 Murakami et al.
2005/0158648 A1 7/2005 Makino et al.
2006/0124784 A1 6/2006 Takahashi et al.
2007/0031754 A1 2/2007 Murakami et al.

FOREIGN PATENT DOCUMENTS

JP 5-023610 2/1993
JP 6-071194 3/1994
JP 8-052376 2/1996
JP 2010-284634 12/2010

* cited by examiner

*Primary Examiner* — Mark Rosenbaum
(74) *Attorney, Agent, or Firm* — Oblon, Spivak, McClelland, Maier & Neustadt, L.L.P.

(57) ABSTRACT

A pulverizer including a solid-gas mixer to mix a compressed gas and particles of a raw material to be pulverized to prepare a solid-gas mixture; a particle path controlling nozzle connected with the solid-gas mixer to feed the solid-gas mixture fed from the solid-gas mixer while accelerating the solid-gas mixture and controlling the particles of the raw material so as to choose different flow paths based on particle diameters of the particles of the raw material; a collision member; and an accelerating tube connected with the particle path controlling nozzle to further accelerate the solid-gas mixture fed from the particle path controlling nozzle while maintaining the flow paths of the particles and ejecting the accelerated solid-gas mixture toward the collision member to pulverize the raw material.

15 Claims, 3 Drawing Sheets

PULVERIZER, PULVERIZATION METHOD, TONER PRODUCTION METHOD, AND TONER

CROSS-REFERENCE TO RELATED APPLICATIONS

This patent application is based on and claims priority pursuant to 35 U.S.C. §119 to Japanese Patent Application No. 2011-172216 filed on Aug. 5, 2011 in the Japan Patent Office, the entire disclosure of which is hereby incorporated herein by reference.

FIELD OF THE INVENTION

The present invention relates to a pulverizer. Particularly, the present invention relates to a collision pulverizer using jet stream. In addition, the present invention also relates to a pulverization method and a toner production method using the pulverizer, and a toner produced by the toner production method.

BACKGROUND OF THE INVENTION

For example, Japanese patents Nos. 3,219,955, 3,108,820 and 3,090,547 have disclosed collision airflow pulverizers which pulverize a material using jet stream to produce a particulate material having an average particle diameter on the order of microns. The pulverizers include a compressed gas supplying nozzle, an accelerating tube, a pulverizing chamber including a collision member therein, and a classifier. The accelerating tube has an entrance, from which a compressed gas is fed into the accelerating tube, an inlet from which a raw material to be pulverized is supplied, and an exit from which a mixture of the compressed gas and the supplied raw material is ejected. The entrance of the accelerating tube is connected with the compressed gas supplying nozzle, and the exit thereof is connected with the pulverizing chamber in such a manner that the exit faces the collision member.

In the above-mentioned pulverizers, a raw material is pulverized as follows. Initially, a compressed gas supplied to the compressed gas supplying nozzle is further compressed therein while accelerated to a subsonic speed. The compressed gas thus accelerated is supplied to the accelerated tube, and the accelerated tube accelerates the compressed gas while controlling expansion of the gas. On the way of the acceleration operation, a raw material to be pulverized is supplied from the inlet to be mixed with the compressed gas. The solid-gas mixture of the compressed gas and the raw material is further accelerated in the accelerating tube, and then ejected from the exit of the accelerating tube. The raw material in the ejected mixture is collided with the collision member, resulting in pulverization of the raw material. The pulverized raw material (i.e., a particulate material) is collected by the classifier, and particles having particle diameters in the desired particle diameter range are collected while particles having particle diameters greater than the desired particle diameter range are fed to the inlet of the accelerating tube to be pulverized again.

However, in the pulverizers mentioned above, in which the inlet is provided on a portion of the accelerating tube, rapid density change is caused in the vicinity of the inlet, and therefore a problem in that a shock wave such as a diamond shock wave is generated tends to be caused. When such a shock wave is generated, the velocity of the solid-gas mixture of the compressed gas and the raw material is decreased, and therefore it becomes difficult to eject the solid-gas mixture at the desired velocity. As a result, the collision energy of the raw material collided with the collision member is seriously decreased, and it becomes difficult to produce a particulate material having the desired particle diameter by one collision pulverization operation, resulting in deterioration of the pulverization efficiency of the pulverizers.

A conventional pulverizer will be described in detail by reference to FIG. 6. FIG. 6 illustrates a conventional pulverizer 100*a* in which an inlet 9*b* is provided on a middle portion of an accelerating tube 9. The pulverizer 100*a* includes a compressed gas supplying nozzle 8, the accelerating tube 9, a raw material supplier 1 to supply a raw material to be pulverized, a pulverizing chamber 10 in which a collision member 11 is provided, a cyclone 12 to separate pulverized particles, and a hopper 13 to collect the pulverized particles (i.e., a product). Numerals 5 and 6 respectively denote a pressure adjusting valve and a pressure controller, which serve as a pressure controller, and numeral 7 denotes a gas flow pipe.

In the pulverizer 100*a*, the raw material to be pulverized is supplied to the accelerated tube 9 from the raw material suppler 1 through the inlet 9*b*. Therefore, rapid density change is caused in the vicinity of the inlet 9*b*, thereby often generating a shock wave such as a diamond shock wave. When such a shock wave is generated, the velocity of the solid-gas mixture of the compressed gas and the raw material in the accelerating tube 9 is decreased, and therefore it becomes difficult to eject the mixture at the desired velocity. As a result, the collision energy of the raw material collided with the collision member is seriously decreased, and it becomes difficult to produce a particulate material having the desired particle diameter by one collision pulverization operation, resulting in deterioration of the pulverization efficiency of the pulverizers.

In addition, generation of a shock wave not only decreases the velocity of the solid-gas mixture of the compressed gas and the raw material in the accelerating tube 9, but also forms airflow flowing toward a lower side (bottom) of the accelerating tube 9. Therefore, the solid-gas mixture is mainly fed to a lower side of the collision member, and the particles of the raw material are collided with substantially the same portion on the lower side of the collision member 11. As a result, the portion of the collision member is seriously abraded, and therefore the collision member 9 has to be frequently replaced with a new collision member, resulting in decrease of the maintenance operation cycle and increase of the maintenance costs.

In attempting to prevent occurrence of the problem, a published unexamined Japanese patent application No. 2010-284634 (hereinafter JP2010-284634A) discloses a pulverizer which includes a solid-gas supplying nozzle, and an accelerating tube to eject a raw material to be pulverized toward a collision member. The pulverizer further includes a solid-gas mixer to mix a compressed gas and the raw material while supplying the solid-gas mixture to the solid-gas supplying nozzle. Since the solid-gas mixture of the compressed gas and the material prepared by the solid-gas mixer is supplied to the accelerating tube through the solid-gas supplying nozzle, it is not necessary to form an inlet, from which the raw material is supplied to the accelerating tube, on the accelerating tube, and therefore generation of a shock wave can be prevented, thereby preventing decrease of the velocity of the solid-gas mixture of the compressed gas and the raw material, resulting in ejection of the solid-gas mixture from an ejection opening of the accelerating tube at a desired velocity. Therefore, a particulate material (product) having the desired particle diameter can be prepared by one collision pulverization operation, namely a particulate material can be prepared without causing the pulverization efficiency deterioration problem caused by a shock wave.

However, the particle diameter of particles of the raw material, which are supplied to the solid-gas mixer, varies. The particles of the raw material in the solid-gas mixture supplied to the solid-gas supplying nozzle are fed along a path corresponding to the flowing direction of the solid-gas mixture regardless of the particle diameters of the particles, and then collided with the collision member. Therefore, particles having a relatively small particle diameter tend to be excessively pulverized, and the pulverized particles tend to have a smaller particle diameter than the targeted particle diameter. In contrast, particles having a relatively large particle diameter tend to be insufficiently pulverized, and the pulverized particles tend to have a larger particle diameter than the targeted particle diameter. Therefore the pulverized particles have to be returned to the solid-gas mixer, resulting in deterioration of the yield of the product.

For these reasons, the inventors recognized that there is a need for a pulverizer which can pulverize a raw material with a high pulverization efficiency without generating a shock wave in an accelerating tube, resulting in production of a pulverized material at a high yield.

BRIEF SUMMARY OF THE INVENTION

As an aspect of the present invention, a pulverizer is provided which includes a solid-gas mixer to mix a compressed gas and particles of a raw material to be pulverized to prepare a solid-gas mixture; a particle path controlling nozzle connected with the solid-gas mixer to feed the solid-gas mixture fed from the solid-gas mixer while accelerating the solid-gas mixture and controlling the particles of the raw material so as to choose different flow paths based on particle diameters of the particles of the raw material; a collision member; and an accelerating tube connected with the particle path controlling nozzle to further accelerate the solid-gas mixture fed from the particle path controlling nozzle while ejecting the accelerated solid-gas mixture toward the collision member to pulverize the raw material.

As another aspect of the present invention, a pulverization method is provided which includes mixing a compressed gas and a raw material to be pulverized to prepare a solid-gas mixture; feeding the solid-gas mixture to a particle path controlling nozzle to accelerate the solid-gas mixture while controlling particles of the raw material so as to choose different flow paths based on particle diameters of the particles of the raw material; further accelerating the accelerated solid-gas mixture in an accelerating tube while maintaining the flow paths of the particles; and ejecting the accelerated solid-gas mixture from the accelerating tube toward a collision member to pulverize the raw material.

As yet another aspect of the present invention, a toner production method is provided which includes pulverizing a raw toner, which includes at least a binder resin, a colorant and a charge controlling agent and which has an average particle diameter, using the pulverizer mentioned above to prepare a toner having an average particle diameter smaller than the average particle diameter of the raw toner.

As a further aspect of the present invention, a toner is provided which includes at least a binder resin, a colorant and a charge controlling agent, wherein the toner is prepared by pulverizing a raw toner, which includes the binder resin, the colorant and the charge controlling agent, using the pulverizer mentioned above so that the toner has an average particle diameter smaller than the average particle diameter of the raw toner.

The aforementioned and other aspects, features and advantages will become apparent upon consideration of the following description of the preferred embodiments taken in conjunction with the accompanying drawings.

DETAILED DESCRIPTION OF THE INVENTION

An example of the pulverizer of the present invention will be described by reference to drawings.

Figure 1:
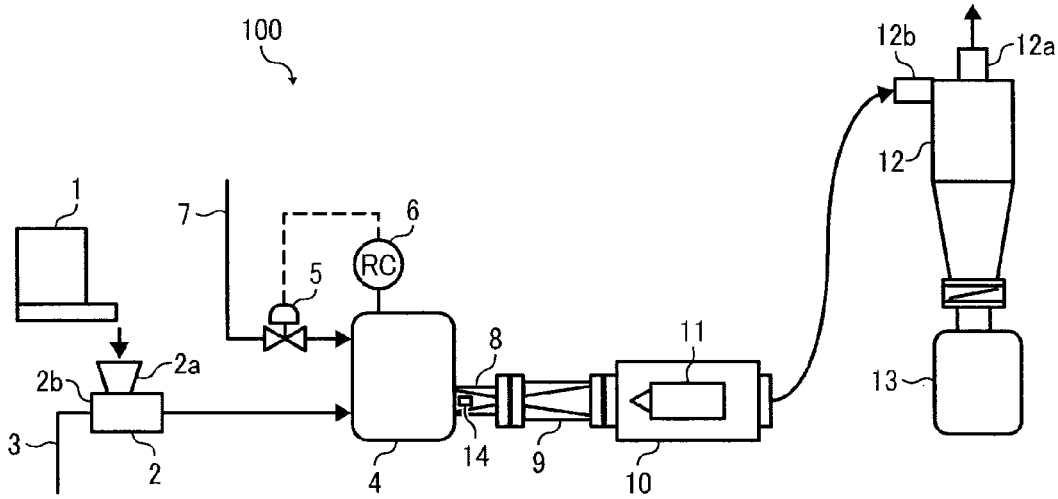
FIG. 1 is a schematic view illustrating an example of the pulverizer of the present invention.

FIG. 1 is a schematic view illustrating a pulverizer 100, which is an example of the pulverizer of the present invention and which is a collision pulverizer using jet stream. The pulverizer 100 includes a particle path controlling nozzle 8 in which a particle path controlling member 14 is arranged, an accelerating tube 9 connected with the particle path controlling nozzle 8, and a pulverizing chamber 10 in which a collision member 11 is arranged, wherein a raw material is collided with the collision member to be pulverized. In addition, the pulverizer 100 includes a solid-gas mixer 4, which is connected with an entrance of the particle path controlling nozzle 8 and which mixes the raw material with a carrier gas such as air.

The pressure inside the solid-gas mixer 4 is adjusted to a predetermined pressure by a pressure controller including a pressure adjusting valve 5 and a pressure controller 6. In addition, a high pressure ejector 2 is connected with the solid-gas mixer 4 through a pipe. The high pressure ejector 2 includes a raw material feeder 2*a* and a gas receiver 2*b*, which is connected with an air supplying tube 3. The air supplying tube 3 is connected with a compressor or the like.

Compressed air supplied by a compressor or the like to the high pressure ejector 2 is accelerated in the high pressure ejector 2, and then changed to low pressure stream at a raw material feeder 2*a*. Therefore, the raw material to be pulverized, which is supplied to the raw material feeder 2*a* from a raw material volumetric feeder 1, is fed into the high pressure ejector 2 by an ejector effect. The raw material thus fed into the high pressure ejector 2 is supplied to the solid-gas mixer 4 together with compressed air.

The mixture of compressed air and the raw material fed into the solid-gas mixer 4 is supplied to the particle path controlling nozzle 8 while achieving a predetermined pressure and a high dispersing state such that the raw material is well dispersed in compressed air.

The difference between the conventional pulverizer 100*a* illustrated in FIG. 6 and the pulverizer 100 of the present invention illustrated in FIG. 1 is as follows. Specifically, the conventional pulverizer 100*a* does not have a solid-gas mixer (such as the solid-gas mixer 4), and has a raw material inlet 9*b* on the accelerating tube while the pulverizer 100 of the present invention does not have a raw material inlet on the accelerating tube. In addition, the particle path controlling member 14 provided in the particle path controlling nozzle 8 in the pulverizer 100 of the present invention, but the conventional pulverizer 100*a* does not have such a particle path controlling member. Further, in the conventional pulverizer 100*a*, which does not have a solid-gas mixer, a pressure controller including a pressure adjusting valve (such as the pressure adjusting valve 5) and a pressure controller (such as the pressure controller 6) is connected with the particle path controlling nozzle 8 while a pressure controller is connected with the solid-gas mixer 4 in the pulverizer 100 of the present invention.

Figure 2:
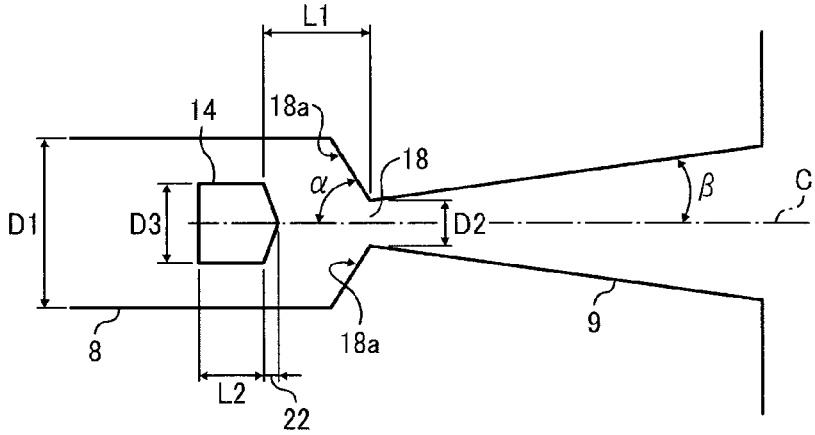
FIG. 2 is a schematic view illustrating the flow passage of a particle path controlling nozzle and an accelerating tube of the pulverizer illustrated in FIG. 1.
Figure 3:
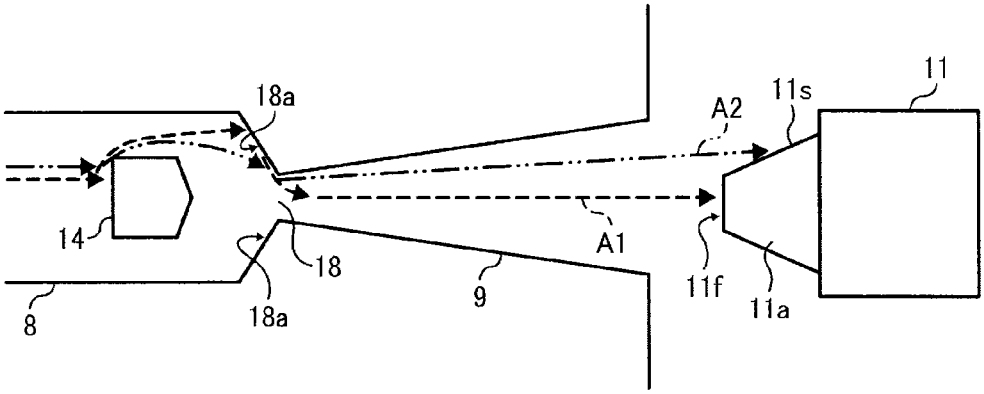
FIG. 3 is a schematic view for describing flow paths of particles of a material to be pulverized in the particle path controlling nozzle and the accelerating tube illustrated in FIG. 2.

FIG. 2 is an enlarged view illustrating the flow passage in the particle path controlling nozzle 8 and the accelerating tube 9, and FIG. 3 is a schematic view for describing flow paths of particles of a raw material to be pulverized.

As illustrated in FIGS. 2 and 3, a narrow nozzle throat 18 is formed at the boundary between the particle path controlling nozzle 8 and the accelerating tube 9, and the particle path controlling nozzle 8 has a throat surface 18*a* which is slanted so as to become thinner in the raw material flowing direction. In addition, a cylindrical particle path controlling member 14 is arranged on an upstream side from the throat surface 18*a* relative to the raw material flowing direction. The particle path controlling member 14 has a cone-shaped projection 22 at the rear end portion thereof to control the flow paths of particles of the raw material fed from the upstream side of the particle path controlling nozzle 8 such that the particles are fed toward the inner surface of the particle path controlling nozzle 8.

Thus, the particle path controlling member 14 changes the flowing direction of the solid-gas mixture, which is supplied to the particle path controlling nozzle 8, such that the mixture is fed toward the throat surface 18*a* and flows along the throat surface 18*a*. In this regard, as the solid-gas mixture flows toward the nozzle throat 18, the mixture is accelerated to a subsonic speed.

As illustrated in FIG. 3, in the nozzle throat 18, the raw material particles flowing along the throat surface 18*a* follow different flow paths based on the particle diameters of the particles because particles having different particle diameters have different inertia forces. By properly setting a nozzle throat angle $\alpha$, it becomes possible to change the flow paths of the raw material particles such that a relatively large particle follows a flow path A1 near a center line C (illustrated in FIG. 2), and a relatively small particle follows a flow path A2 near the inner surface of the accelerating tube 9. Therefore, even when the particle diameters of the raw material particles change, the raw material particles can be fed so as to collide against different collision points of the collision member 11. Namely, the raw material particles can be pulverized under most suitable conditions.

The accelerating tube 9 is a Laval nozzle, which becomes thicker in the raw material flowing direction, and has no raw material supplying opening thereon (i.e., no opening is formed on a portion of the accelerating tube 9 between the entrance (i.e., the nozzle throat 18) and the exit thereof (i.e., an ejection opening). Therefore, the raw material particles in the solid-gas mixture, which is supplied from the nozzle throat 18 into the accelerating tube 9 and accelerated to a subsonic speed, are fed such that the flow paths thereof are further separated depending on the particle diameters thereof as illustrated in FIG. 3 by the broken line A1 and the two-dot chain line A2. The solid-gas mixture is accelerated in the accelerating tube 9 while expanded, and then ejected from the ejection opening of the accelerated tube 9 at a supersonic speed.

As mentioned above, the accelerating tube 9 has no raw material supplying opening thereon, and therefore rapid density change is not caused in the solid-gas mixture fed in the accelerating tube 9, thereby generating no shock wave. Therefore, occurrence of a problem in that the feeding speed of the solid-gas mixture decreases in the accelerating tube 9 can be prevented. Thus, the solid-gas mixture can be securely accelerated to a supersonic speed while the raw material particles in the solid-gas mixture are separated so as to choose different flow paths based on the particle diameters of the particles.

The solid-gas mixture accelerated to a supersonic speed in the accelerating tube 9 is ejected from the ejection opening toward the collision member 11 in the pulverizing chamber 10.

Figure 4:
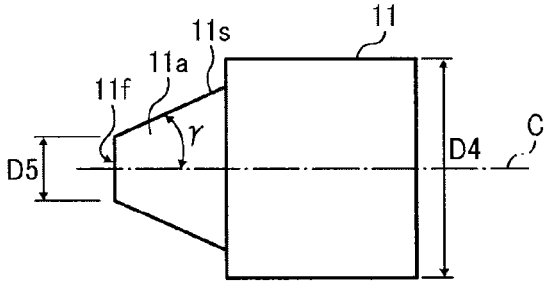
FIG. 4 is a schematic view illustrating a collision member for use in the pulverizer of the present invention.

FIG. 4 is an enlarged view illustrating the collision member 11. The collision member 11 has a truncated cone portion 11*a* having a flat surface 11*f*, and is opposed to the ejection opening of the accelerating tube 9.

The raw material particles in the solid-gas mixture ejected from the ejection opening of the accelerating tube 9 are collided with the collision member 11 in such a manner that a relatively large particle is collided with the flat surface 11*f*, and a relatively small particle is collided with a side surface 11*s* of the truncated cone portion 11*a*. In this regard, the flat surface 11*f* is closer to the ejection opening of the accelerated tube 9, and therefore the velocity of a particle (relatively large particle) collided with the flat surface 11*f* is hardly decreased. In addition, since a relatively large particle is collided with the flat surface 11*f* at a right angle, a maximum collision energy is applied to the relatively large particle. In contrast, the side surface 11*s* of the truncated cone portion 11*a* is farther from the ejection opening, and therefore the velocity of a particle (relatively small particle) collided with the side surface 11*s* is decreased. In addition, as the particle diameter of such a relatively small particle decreases, the collision angle (formed by the line A2 and the side surface 11*s*) decreases. Therefore, the collision energy applied to a relatively small particle decreases as the particle diameter of the small particle decreases. Thus, large particles and small particles receive proper collision energies, and therefore the pulverized particles can have particle diameters in a desired particle diameter range without causing the non-pulverization problem and the excessive pulverization problem.

In addition, since the collision member 11 has a cone form, the high speed stream ejected toward the collision member 11 is smoothly flown along the side surface 11*s* of the cone-form collision member 11 by the Coanda effect, and therefore the pulverized particles are smoothly flown toward the backside of the collision member 11.

The pulverized raw material is then flown toward an exit of the pulverization chamber 10 by the stream smoothly flowing along the surface of the collision member 11, and then discharged from the pulverizing chamber 10. The pulverized raw material thus discharged from the pulverizing chamber 10 is fed to the cyclone 12 through a tube to be subjected to a solid-gas separation treatment, followed by collection of a product (a particulate material) using the collection hopper 13.

The cyclone 12 has an upper portion having a cylindrical form, and a lower portion having an inverted truncated cone form, and is rotated by a driving device. The upper portion has an inlet 12*b*, which is connected with the pulverization chamber 10 through a tube. In addition, an exhaust pipe 12*a* is provided on an upper surface of the cyclone 12 so as to be located on a rotation center of the cyclone 12. A suction device such as high pressure blowers is connected with an exhaust pipe 12*a* to suck air in the cyclone 12.

As mentioned above, since raw material particles are pulverized while receiving proper collision energies in the pulverizing chamber 10 even when the particle diameters thereof are different, the pulverized raw material supplied from an inlet 12*b* of the cyclone together with compressed air has a sharp particle diameter distribution, and therefore the amount of particles having particle diameters falling out of the desired particle diameter range is small. However, depending on the requirement for the average particle diameter range of the product, it is possible to return particles which have particle diameters falling out of the desired particle diameter range and which are moved toward the inner wall of the cyclone by centrifugal force, to the high pressure ejector 2 through the raw material feeder 2*a* to pulverize again the particles.

Although the pulverizer 100 uses a cyclone (cyclone 12), airflow classifiers or mechanical classifiers may be used when a product having a sharper particle diameter distribution is prepared.

Since the pulverizer 100 uses the high pressure ejector 2 to supply a raw material to the solid-gas mixer 4, the pressure in the solid-gas mixer 4 can be easily increased to a pressure sufficient for pulverizing the raw material.

In addition, since the pressure in the solid-gas mixer 4 is controlled using the pressure adjuster 5 and the pressure controller 6, the flow speed of the solid-gas mixture ejected from the ejection opening of the accelerating tube 9 can be adjusted, and therefore the particle diameter of the pulverized product can be easily adjusted so as to fall in the desired particle diameter range.

The pulverizer 100 of the present invention can be preferably used for producing a particulate material such as particles of resins, agrichemicals, cosmetics, and pigments having particle diameters on the order of microns. The pulverizer 100 is more preferably used for producing toner.

Similarly to the above-mentioned conventional pulverizer disclosed by JP2010-284634A, the pulverizer 100 of the present invention includes a solid-gas mixer (solid-gas mixer 4), and a solid-gas mixture prepared in the solid-gas mixer 4 is supplied to the particle path controlling nozzle 8. Therefore, generation of a shock wave in the accelerating tube 9 can be prevented, and the pulverization efficiency can be enhanced. In addition, formation of a stream toward the lower side of the accelerating tube 9, which is caused by a shock wave, can be prevented, thereby preventing occurrence of the problem in that the solid-gas mixture strikes substantially the same portion of the collision member 11, and the portion is seriously abraded, resulting in deterioration of the life of the collision member 11, shortening of the maintenance cycle, and increase of the maintenance costs.

The particle diameter of particles of a raw material to be supplied to the solid-gas mixer varies. In the above-mentioned pulverizer disclosed by JP2010-284634A, particles of a raw material supplied to the solid-gas supplying nozzle are collided with the collision member after flown by the gas in the solid-gas mixture so as to follow the flow path of the solid-gas mixture independently of the particle diameters thereof. Therefore, particles having a relatively small particle diameter tend to be excessively pulverized, and the amount of pulverized particles having a smaller particle diameter than the targeted particle diameter increases, resulting in deterioration of the yield of the product. In contrast, particles having a relatively large particle diameter tend to be insufficiently pulverized, and the pulverized particles tend to have a larger particle diameter than the targeted particle diameter and the amount of large particles be returned to the solid-gas mixer increases, resulting in deterioration of the pulverization efficiency and the yield of the product.

In contrast, the pulverizer 100 of the present invention includes a particle path controlling nozzle including the particle path controlling member 14 and the throat surface 18*a*. The flow path of particles of the raw material supplied to the particle path controlling nozzle 8 is controlled such that the particles choose different flow paths based on the particle diameters thereof. Specifically, a particle having a larger particle diameter follows a flow path nearer the center of the accelerating tube 9, and a particle having a smaller particle diameter follows a flow path farther from the center of the accelerating tube 9 (i.e., a flow path nearer the inner surface of the accelerating tube 9). Therefore, the collision member has a shape such that a particle having a larger particle diameter and following a flow path nearer the center of the accelerating tube 9 receives a higher collision energy, and a particle having a smaller particle diameter and following a flow path farther from the center of the accelerating tube 9 receives a lower collision energy. Accordingly, excessive pulverization and insufficient pulverization can be avoided, and therefore the amount of large particles returned to the solid-gas mixer 4 through the raw material supplier 1, and the amount of small particles removed from the product can be decreased, resulting in increase of the yield of the product.

Thus, in the pulverizer 100 of the present invention, decrease in velocity of the solid-gas mixture in the accelerating tube 9 can be prevented while preventing formation of a stream toward a lower side of the accelerating tube 9, thereby making it possible that the solid-gas mixture is ejected from the ejection opening of the accelerating tube 9 at a desired velocity without causing the problem in that the raw material particles in the solid-gas mixture strike substantially the same portion of the collision member 11. In addition, since the particle path controlling member 14 is provided in the particle path controlling nozzle 8, it is possible that particles of the raw material are separated so as to follow different flow paths at the nozzle throat 18 based on the particle diameters thereof. By combining this effect and the effect produced by the configuration in which the solid-gas mixture prepared in the solid-gas mixer 4 is supplied to the particle path controlling nozzle 8, particles of the raw material ejected from the ejection opening of the accelerating tube 9 strike proper portions of the collision member 11 at a desired velocity, thereby applying proper collision energy to each of the particles. Therefore, it becomes possible to pulverize the raw material particles with the collision member so as to have particle diameters in a desired particle diameter range by performing one pulverization operation, thereby increasing the pulverization efficiency and the yield of the product without causing the problem in that a portion of the collision member 11 is seriously abraded, resulting in shortening of the life of the collision member.

In the pulverizer 100 illustrated in FIG. 1, a raw material is supplied to the solid-gas mixer 4 using the high pressure ejector 2. However, the raw material supplier is not limited to such a high pressure ejector, and a high pressure screw feeder in which a pressure equal to that of the compressed gas is applied can also be used.

Figure 5:
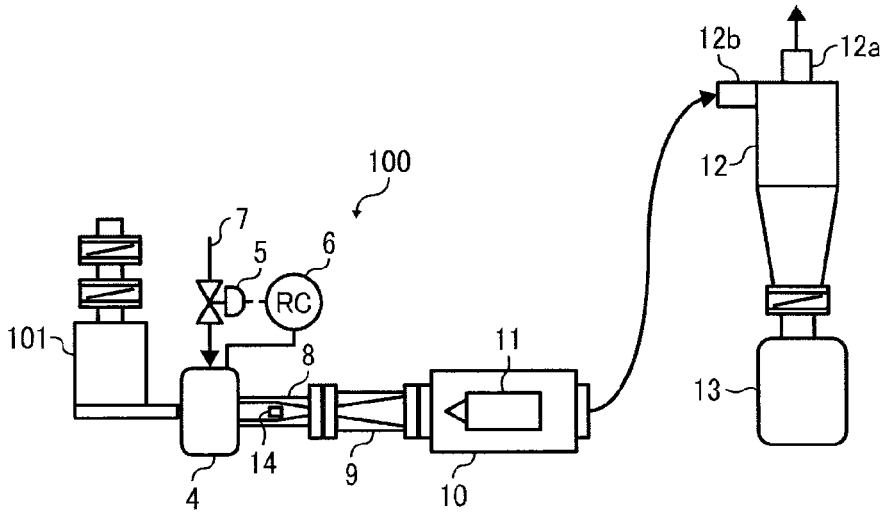
FIG. 5 is a schematic view illustrating another example of the pulverizer of the present invention, which includes a high pressure screw feeder to feed a raw material to be pulverized.

FIG. 5 is a schematic view illustrating a pulverizer 100 equipped with a high pressure screw feeder 101.

Since the pulverizer 100 illustrated in FIG. 5 uses a high pressure screw feeder 101, a raw material can be quantitatively supplied to the solid-gas mixer 4 with little variation. In addition, since a compressed gas is not used for supplying a raw material, the amount of a compressed gas used can be reduced.

Further, in the solid-gas mixer 4 of the pulverizer 100 illustrated in FIG. 5, a compressed gas is fed from a direction perpendicular to the raw material flowing direction. Therefore, particles of the raw material can be well dispersed in the compressed gas fed into the solid-gas mixer 4, and the particles can be more securely collided with proper portions of the collision member. By feeding a compressed gas from a direction perpendicular to the raw material flowing direction, the raw material can be well dispersed in the compressed gas while controlling the concentration of particles of the raw material in the compressed gas so as to be constant, thereby making it possible to collide the raw material particles with proper portions of the collision member, resulting in performing of highly efficient pulverization.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A raw material (i.e., a raw toner) was pulverized using the pulverizer 100 illustrated in FIG. 1. The raw material was prepared as follows.

The following components were mixed using a SUPER MIXER mixer from Kawata MFG Co., Ltd.

| | |
|---|---|
| Polyester resin (binder resin) | 100 parts |
| Phthalocyanine pigment (colorant) | 8 parts |
| Zinc salicylate (charge controlling agent) | 2 parts |

The mixture was heated to 150° C., and then kneaded, followed by cooling to room temperature to solidify the kneaded mixture. The cooled mixture was crushed by a hammer mill so as to have a diameter of not greater than 50 μm.

The thus prepared raw material was pulverized using a pulverizer having such a structure as illustrated in FIG. 1. In this regard, the cyclone 12 was not used, and all the pulverized raw material was collected by the collection hopper 13.

Specifically, the raw material is supplied from the raw material feeder 1 to the high pressure ejector 2 at a feed rate of 0.5 kg/h, and a solid-gas mixture of the raw material and compressed air having a pressure of 8.0 MPa was fed to the solid-gas mixer 4. The pressure in the solid-gas mixer 4 (i.e., pulverization pressure) was adjusted to 0.6 MPa by the pressure adjusting valve 5 and the pressure controller 6. The solid-gas mixture of the raw material and compressed air dispersed in the solid-gas mixer 4 was supplied to the particle path controlling nozzle 8 having the particle path controlling member 14 therein, and then accelerated in the particle path controlling nozzle 8 and the accelerating tube 9 to a supersonic speed so that particles of the raw material choose proper flow paths based on the particle diameters thereof and then collided with the collision member 11.

The pulverizing conditions of the pulverizer 100 are mentioned below. In the below-mentioned pulverizing conditions, as illustrated in FIG. 2, D1 represents the inner diameter of the particle path controlling nozzle 8, D2 represents the inner diameter of the nozzle throat 18, and D3 represents the diameter of the particle path controlling member 14. In addition, as illustrated in FIG. 4, D4 represents the outer diameter of the collision member 11, and D5 represents the diameter of the flat surface 11*f* of the truncated cone portion 11*a*. Further, as illustrated in FIG. 2, L1 represents the distance between the rear end of the particle path controlling member 14 and the nozzle throat 18, and L2 represents the length of the particle path controlling member 14.

In addition, as illustrated in FIG. 2, the nozzle throat angle α is an angle formed by the center line C of the flow passage and the throat surface 18*a*, and the Laval angle β is an angle formed by the center line C and the inner surface of the accelerating tube 9. Further, the angle γ of the truncated cone portion 11*a* of the collision member 11 is an angle formed by the center line C and the side surface 11*s* of the truncated cone portion 11*a*.

Nozzle throat angle α: 80°

Laval angle β: 2.5°

Diameter D5 of the flat surface 11*f*: 0.03×D4

Diameter D3 of the particle path controlling member 14: 0.4×D1

Distance L1 between the rear end of the particle path controlling member 14 and the nozzle throat 18: 3.0×D2

Length L2 of the particle path controlling member 14: 1.0×D3

Angle γ between the center line C and the side surface 11*s* of the truncated cone portion 11*a*: 20°

Presence or absence of the projected rear end portion 22 of the particle path controlling member 14: The projected rear end portion 22 is present.

Feeding direction of compressed gas: Parallel to the particle feeding direction

The pulverized raw material (i.e., a particulate material, toner) collected by the collection hopper 13 was evaluated with respect to the following properties.

(1) Average particle diameter Dp50

(2) Ratio Dv/Dn of volume average particle diameter (Dv) to number average particle diameter (Dn)

When the ratio Dv/Dn of the particulate material is smaller, the particulate material has a sharper particle diameter distribution.

The evaluation results of the particulate material of Example 1 are shown in Table 1-1 below.

Example 2

The procedure for preparation of the particulate material in Example 1 was repeated except that the nozzle throat angle α was changed to 30°.

The evaluation results of the particulate material of Example 2 are shown in Table 1-1 below.

Example 3

The procedure for preparation of the particulate material in Example 1 was repeated except that the Laval angle β was changed to 4°.

The evaluation results of the particulate material of Example 3 are shown in Table 1-1 below.

Example 4

The procedure for preparation of the particulate material in Example 1 was repeated except that the diameter D5 of the flat surface 11*f* was changed to 0.3×D4.

The evaluation results of the particulate material of Example 4 are shown in Table 1-1 below.

Example 5

The procedure for preparation of the particulate material in Example 1 was repeated except that the diameter D3 of the particle path controlling member 14 was changed to 0.25× D1.

The evaluation results of the particulate material of Example 5 are shown in Table 1-1 below.

Example 6

The procedure for preparation of the particulate material in Example 1 was repeated except that the diameter D3 of the particle path controlling member 14 was changed to 0.60× D1.

The evaluation results of the particulate material of Example 6 are shown in Table 1-1 below.

Example 7

The procedure for preparation of the particulate material in Example 1 was repeated except that the distance L1 between the rear end of the particle path controlling member 14 and the nozzle throat 18 was changed to 1.0×D2.

The evaluation results of the particulate material of Example 7 are shown in Table 1-2 below.

Example 8

The procedure for preparation of the particulate material in Example 1 was repeated except that the length L2 of the particle path controlling member 14 was changed to 3.0×D3.

The evaluation results of the particulate material of Example 8 are shown in Table 1-2 below.

Example 9

The procedure for preparation of the particulate material in Example 1 was repeated except that the angle γ between the center line C and the side surface 11*s* of the truncated cone portion 11*a* was changed to 10°.

The evaluation results of the particulate material of Example 9 are shown in Table 1-2 below.

Example 10

The procedure for preparation of the particulate material in Example 1 was repeated except that the particle path controlling member 14 did not have the projected rear end portion 22.

The evaluation results of the particulate material of Example 10 are shown in Table 1-2 below.

Example 11

The procedure for preparation of the particulate material in Example 1 was repeated except that the high pressure screw feeder 101 was used instead of the combination (raw material supplier) of the raw material feeder 1 and the high pressure ejector 2 (i.e., the pulverizer 100 illustrated in FIG. 5 was used except that the compressed gas feeding direction is parallel to the raw material feeding direction).

The evaluation results of the particulate material of Example 11 are shown in Table 1-2 below.

Example 12

The procedure for preparation of the particulate material in Example 11 was repeated except that the pulverizer 100 illustrated in FIG. 5, in which the compressed gas feeding direction is perpendicular to the raw material feeding direction, was used.

The evaluation results of the particulate material of Example 12 are shown in Table 1-2 below.

Comparative Example

Figure 6:
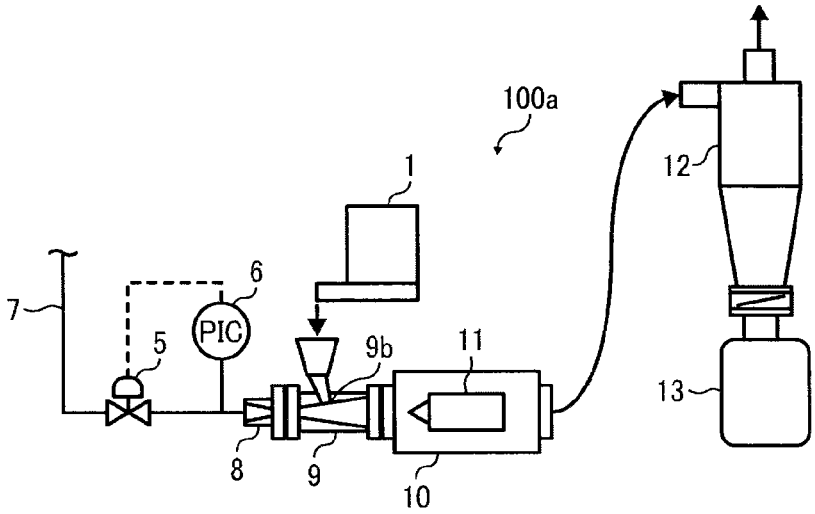
FIG. 6 RELATED ART
FIG. 6 is a schematic view illustrating a conventional pulverizer.

The procedure for preparation of the particulate material in Example 1 was repeated except that the conventional pulverizer 100*a* illustrated in FIG. 6 was used.

The evaluation results of the particulate material of Comparative Example are shown in Table 1-2 below.

TABLE 1-1

| | Ex. 1 | Ex. 2 | Ex. 3 | Ex. 4 | Ex. 5 | Ex. 6 |
|---|---|---|---|---|---|---|
| Amount of raw material supplied (kg) | 0.5 | 0.5 | 0.5 | 0.5 | 0.5 | 0.5 |
| Feed rate of raw material (kg/h) | 0.5 | 0.5 | 0.5 | 0.5 | 0.5 | 0.5 |
| Pulverization pressure (MPa) | 0.6 | 0.6 | 0.6 | 0.6 | 0.6 | 0.6 |
| Ejector pressure (MPa) | 8.0 | 8.0 | 8.0 | 8.0 | 8.0 | 8.0 |
| Raw material feeding method | Ejector | Ejector | Ejector | Ejector | Ejector | Ejector |
| Nozzle throat angle α (°) | 80 | 30 | 80 | 80 | 80 | 80 |
| Laval angle β (°) | 2.5 | 2.5 | 4.0 | 2.5 | 2.5 | 2.5 |
| D5 | 0.03 × D4 | 0.03 × D4 | 0.03 × D4 | 0.3 × D4 | 0.03 × D4 | 0.03 × D4 |
| D3 | 0.4 × D1 | 0.4 × D1 | 0.4 × D1 | 0.4 × D1 | 0.25 × D1 | 0.6 × D1 |
| L1 | 3.0 × D2 | 3.0 × D2 | 3.0 × D2 | 3.0 × D2 | 3.0 × D2 | 3.0 × D2 |
| L2 | 1.0 × D3 | 1.0 × D3 | 1.0 × D3 | 1.0 × D3 | 1.0 × D3 | 1.0 × D3 |
| Angle γ (°) | 20 | 20 | 20 | 20 | 20 | 20 |
| Presence or absence of the | Present | Present | Present | Present | Present | Present |

TABLE 1-1-continued

| | Ex. 1 | Ex. 2 | Ex. 3 | Ex. 4 | Ex. 5 | Ex. 6 |
|---|---|---|---|---|---|---|
| projected rear end portion 22 | | | | | | |
| Compressed gas feeding direction | Parallel to raw material feeding direction | Parallel to raw material feeding direction | Parallel to raw material feeding direction | Parallel to raw material feeding direction | Parallel to raw material feeding direction | Parallel to raw material feeding direction |
| Average particle diameter Dp50 (μm) | 9.4 | 11.7 | 9.5 | 9.0 | 9.6 | 10.4 |
| Dv/Dn | 1.53 | 1.74 | 1.57 | 1.72 | 1.59 | 1.70 |

TABLE 1-2

| | Ex. 7 | Ex. 8 | Ex. 9 | Ex. 10 | Ex. 11 | Ex. 12 | Comp. Example |
|---|---|---|---|---|---|---|---|
| Amount of raw material supplied (kg) | 0.5 | 0.5 | 0.5 | 0.5 | 0.5 | 0.5 | 0.5 |
| Feed rate of raw material (kg/h) | 0.5 | 0.5 | 0.5 | 0.5 | 0.5 | 0.5 | 0.5 |
| Pulverization pressure (MPa) | 0.6 | 0.6 | 0.6 | 0.6 | 0.6 | 0.6 | 0.6 |
| Ejector pressure (MPa) | 8.0 | 8.0 | 8.0 | 8.0 | — | — | 8.0 |
| Raw material feeding method | Ejector | Ejector | Ejector | Ejector | Screw | Screw | Ejector |
| Nozzle throat angle α (°) | 80 | 80 | 80 | 80 | 80 | 80 | 80 |
| Laval angle β (°) | 2.5 | 2.5 | 2.5 | 2.5 | 2.5 | 2.5 | 2.5 |
| D5 | 0.03 × D4 | 0.03 × D4 | 0.03 × D4 | 0.03 × D4 | 0.03 × D4 | 0.03 × D4 | 0.03 × D4 |
| D3 | 0.4 × D1 | 0.4 × D1 | 0.4 × D1 | 0.4 × D1 | 0.4 × D1 | 0.4 × D1 | — |
| L1 | 1.0 × D2 | 3.0 × D2 | 3.0 × D2 | 3.0 × D2 | 3.0 × D2 | 3.0 × D2 | — |
| L2 | 1.0 × D3 | 3.0 × D3 | 1.0 × D3 | 1.0 × D3 | 1.0 × D3 | 1.0 × D3 | — |
| Angle γ (°) | 20 | 20 | 10 | 20 | 20 | 20 | 20 |
| Presence or absence of the projected rear end portion 22 | Present | Present | Present | Absent | Present | Present | — |
| Compressed gas feeding direction | Parallel to raw material feeding direction | Parallel to raw material feeding direction | Parallel to raw material feeding direction | Parallel to raw material feeding direction | Parallel to raw material feeding direction | Perpendicular to raw material feeding direction | — |
| Average particle diameter Dp50 (μm) | 10.5 | 9.5 | 9.6 | 10.4 | 9.2 | 9.0 | 13.1 |
| Dv/Dn | 1.72 | 1.56 | 1.54 | 1.68 | 1.52 | 1.50 | 2.10 |

It can be understood from Tables 1-1 and 1-2 that products of Examples 1-10 prepared by using the pulverizers 100 of the present invention illustrated in FIG. 1 have relatively small average particle diameters and Dv/Dn ratios (i.e., relatively sharp particle diameter distribution) compared with the product of Comparative Example prepared by using the conventional pulverizer 100*a* illustrated in FIG. 6. This is because the conventional pulverizer 100*a* has the raw material inlet 9*b* on the accelerating tube 9, and rapid density change is caused in the accelerating tube 9, thereby decreasing the flow speed of compressed air in the accelerating tube 9 while forming a stream toward a lower side of the accelerating tube 9. In this case, the solid-gas mixture of the raw material and the gas cannot be ejected at a sufficient velocity from the ejection opening of the accelerating tube 9, and the solid-gas mixture strikes substantially the same portion of the lower side of the collision member 11. Therefore the raw material in the solid-gas mixture receives insufficient collision energy, resulting in formation of a product having a relatively large average particle diameter and a relatively broad particle diameter distribution.

In contrast, in Examples 1-10, the pulverizer 100 illustrated in FIG. 1 is used, and therefore the pulverizer 100 does not cause the rapid density change mentioned above, and therefore formation of a stream flowing toward a lower side of the accelerating tube 9 is prevented while preventing decrease of the velocity of the solid-gas mixture. In addition, particles of the raw material are fed while controlled so as to follow different flow paths based on the particle diameters thereof so that the particles strike proper portion of the collision member 11, thereby applying proper collision energies to the particles. Therefore the products of Examples 1-10 have a relatively small average particle diameter and a relatively sharp particle diameter distribution.

The nozzle throat angle α is smaller in Example 2 (30°) than in Example 1 (80°). When the nozzle throat angle α decreases, inertia force on particles of the raw material decreases, and therefore large particles tend not to strike the center of the collision member 11. Accordingly, the raw material particles cannot receive proper collision energies, and therefore the product of Example 2 has a relatively large average particle diameter and a relatively broad particle diameter distribution compared with the product of Example 1. Therefore, the nozzle throat angle α is preferably 80°.

The Laval angle β is larger in Example 3 (4.0°) than in Example 1 (2.5°). When the Laval angle β increases, the flow paths of the raw material particles are separated widely, and some of large particles do not strike the flat surface 11*f* of the collision member 11, thereby increasing the content of large particles in the product. Accordingly, the product of Example 3 has a relatively large average particle diameter and a relatively broad particle diameter distribution compared with the product of Example 1. Therefore, the Laval angle β is preferably 2.5°.

The diameter D5 of the flat surface 11*f* of the collision member 11 is larger in Example 4 than in Example 1. When the diameter D5 increases, relatively small particles of the raw material strike the flat surface 11*f*, resulting in excessive pulverization of the raw material. Accordingly, the product of Example 4 has a relatively small average particle diameter and a relatively broad particle diameter distribution compared with the product of Example 1. Therefore, the diameter D5 of the flat surface 11*f* of the collision member 11 is preferably equal to 0.03×D4, wherein D4 is the diameter of the collision member 11.

The diameter D3 of the particle path controlling member 14 is smaller in Example 5 than in Example 1. When the diameter D3 becomes relatively small compared with the diameter D1 of the particle path controlling nozzle 8, the amount of particles of the raw material, which do not move along the throat surface 18*a* (i.e., which do not follow proper flow paths), increases, and therefore the product of Example 5 has a relatively large average particle diameter and a relatively broad particle diameter distribution compared with the product of Example 1.

In contrast, the diameter D3 of the particle path controlling member 14 is larger in Example 6 than in Example 1. When the diameter D3 becomes relatively large compared with the diameter D1 of the particle path controlling nozzle 8, the space through which the particles can pass is reduced, and therefore the raw material particles tend to stay in the particle path controlling nozzle 8. Accordingly, the product of Example 6 has a relatively large average particle diameter and a relatively broad particle diameter distribution compared with the product of Example 1. It can be understood from comparison of Example 6 with Example 5 that the diameter D3 in Example 5 (0.25×D1) is better than that in Example 6 (0.6×D1).

Therefore, the diameter D3 of the particle path controlling member 14 is preferably 0.4×D1, wherein D1 is the diameter of the particle path controlling nozzle 8.

The distance L1 between the rear end of the particle path controlling member 14 and the nozzle throat 18 is shorter in Example 7 (1.0×D2) than in Example 1 (3.0×D2). When the distance L1 decreases, the space through which the particles can pass is reduced, and therefore the raw material particles tend to stay in the particle path controlling nozzle 8. Accordingly, the product of Example 7 has a relatively large average particle diameter and a relatively broad particle diameter distribution compared with the product of Example 1. Therefore, the distance L1 between the rear end of the particle path controlling member 14 and the nozzle throat 18 is preferably 3.0×D2, wherein D2 represents the inner diameter of the nozzle throat 18.

The length L2 of the particle path controlling member 14 is longer in Example 8 (3.0×D3) than in Example 1 (1.0×D3). When the length L2 increases, the space through which the particles can pass is reduced, and therefore the raw material particles tend to stay in the particle path controlling nozzle 8. Accordingly, the product of Example 8 has a relatively large average particle diameter and a relatively broad particle diameter distribution compared with the product of Example 1. Therefore, the length L2 of the particle path controlling member 14 is preferably 1.0×D3, wherein D3 is the diameter of the particle path controlling member 14).

The angle γ of the truncated cone portion 11*a* is smaller in Example 9 (10°) than in Example 1 (20°). When the angle γ of the truncated cone portion 11*a* decreases, relatively small particles of the raw material receive relatively small collision energies, and therefore the average particle diameter of the product of Example 9 slightly increases while the particle diameter distribution slightly broadens. Therefore, the angle γ of the truncated cone portion 11*a* is preferably 20°.

The particle path controlling member 14 of the pulverizer used for Example 10 has no projection 22 at the end portion thereof. In this case, turbulent flow is formed in the particle path controlling nozzle 8, thereby causing a force by which the solid-gas mixture is attracted to the particle path controlling member 14. Therefore, particles of the raw material do not follow proper flow paths thereof, and the product of Example 10 has a relatively large average particle diameter and a relatively broad particle diameter distribution compared with the product of Example 1. Therefore, the particle path controlling member 14 preferably has a projection 22 at the end portion thereof As mentioned above, the pulverizer 100, which is an embodiment of the present invention, includes the particle path controlling nozzle 8, and the accelerating tube 9, which is connected with the particle path controlling nozzle 8 and which accelerates a solid-gas mixture of a compressed gas and a raw material supplied from the particle path controlling nozzle 8 to eject the solid-gas mixture toward the collision member 11, thereby pulverizing the raw material. In addition, the pulverizer 100 includes the solid-gas mixer 4, which mixes the raw material with the compressed gas and which supplies the solid-gas mixture to the particle path controlling nozzle 8. Since the gas supplied from the particle path controlling nozzle 8 to the accelerating tube 9 is the mixture of the compressed gas and the raw material, it is not necessary to supply the raw material from the accelerating tube 9 to prepare the solid-gas mixture in the accelerating tube 9. Therefore, unlike the conventional pulverizers mentioned above, it is not necessary to provide a raw material inlet, from which the raw material is supplied, on the accelerating tube 9, thereby preventing formation of a shock wave in the accelerating tube 9. Therefore, decrease of velocity of the solid-gas mixture in the accelerating tube 9 can be prevented, and the solid-gas mixture can be ejected at a sufficient velocity from the ejection opening of the accelerating tube 9. As a result, the raw material can be collided with the collision member 11 with high energy, and a product having a desired particle diameter can be produced by one pulverization operation, resulting in increase of the pulverization efficiency. In addition, since formation of a shock wave can be prevented, occurrence of the problem in that a stream toward a lower side of the accelerating tube 9 is formed by a shock wave and the solid-gas mixture strikes substantially the same portion of the collision member 11, resulting in abrasion of the portion of the collision member can be prevented.

Since the pulverizer 100 further includes a particle path controlling member, particles of the raw material in the solid-gas mixture are controlled to choose different flow paths based on the particle diameters thereof when the particles pass the nozzle throat 18. Specifically, particles having larger particle diameters follow flow paths nearer the center of the accelerating tube 9, and particles having smaller particle diameters follow flow paths farther from the center of the accelerating tube 9 (i.e., flow paths nearer the inner surface of the accelerating tube 9). In addition, the collision member 11 has a shape such that larger particles following flow paths nearer the center of the accelerating tube 9 receives greater collision energies from the collision member while smaller particles following flow paths farther from the center of the accelerating tube 9 receives smaller collision energies from the collision member 11. Since particles of the raw material ejected from the accelerating tube 9 strike proper portions of the collision member 11 at a sufficient velocity. Thus, particles of the raw material can be pulverized by proper collision energies, the amount of smaller pulverized particles to be disposed of and the amount of larger pulverized particles to be returned to the solid-gas mixer 4 through the raw material supplier 1 can be decreased, resulting in production of a product at a high yield without causing the excessive pulverization problem and the non-pulverization problem.

In the pulverizer 100, the particle path controlling member 14 controlling particles supplied from the solid-gas mixer 4 to flow toward the inner surface of the particle path controlling nozzle 8, and the throat surface 18*a* of the particle path controlling nozzle 8, which becomes thinner in the raw material flowing direction, serves as a particle path controller. Since the particle path controller has such a configuration, particles of the raw material in the solid-gas mixture are fed toward the inner surface of the particle path controlling nozzle 8 by the particle path controlling member 14, followed by moving along the inner surface of the particle path controlling nozzle 8 and the throat surface 18*a*. The particles moving along the throat surface 18*a* are allowed to fly obliquely toward the virtual center line C of the nozzle throat 18 as illustrated in FIG. 3. In this regard, the compressed gas flows at the nozzle throat 18 in such a direction as to be parallel to the virtual center line C. Therefore, when the particles reach the nozzle throat 18, relatively small particles, which have smaller inertia, are flown in a direction parallel to the center line C by the compressed gas soon after reaching the throat surface 18*a*, and relatively larger particles, which are not easily flown because of having larger inertia, are flown in a direction parallel to and nearer the center line C by the compressed gas. Therefore, small particles choose flow paths (such as flow path A2 illustrated in FIG. 3) near the inner surface of the accelerating tube 9 while large particles choose flow paths (such as flow path A1 illustrated in FIG. 3) near the virtual center line C. Therefore, by using a particle path controlling member having a proper shape and setting the nozzle throat angle α to a proper angle, flow paths of particles of the raw material can be controlled. Thus, the particle path controller of the pulverizer of the present invention controls the flow paths of particles of a raw material.

As mentioned above, the nozzle throat angle α formed by the virtual center line C and the throat surface 18*a* is 30° in Example 2 and is 80° in Example 1. The product of Example 1 has a smaller (better) average particle diameter and a sharper particle diameter distribution than the product of Example 2. However, the product of Example 2 has a better average particle diameter and a sharper particle diameter distribution than the product of Comparative Example, which is prepared by the conventional pulverizer 100*a*. Therefore, it is confirmed that when the nozzle throat angle α is from 30° to 80°, the resultant products can have a better average particle diameter and a sharper particle diameter distribution than conventional products.

The accelerating tube 9 of the pulverizer 100 is a Laval nozzle, whose inner diameter increases in the flowing direction of the solid-gas mixture. The Laval angle β formed by the virtual center line C and the inner surface of the accelerating tube 9 is 2.5° in Example 1 and is 4.0° in Example 3. The product of Example 1 has a smaller (better) average particle diameter and a sharper particle diameter distribution than the product of Example 3. However, the product of Example 3 has a better average particle diameter and a sharper particle diameter distribution than the product of Comparative Example, which is prepared by the conventional pulverizer 100*a*. Therefore, it is confirmed that when the Laval angle β is from 2.5° to 4.0°, the resultant products can have a smaller (better) average particle diameter and a sharper particle diameter distribution than conventional products.

In the pulverizer 100, the diameter D5 of the flat surface 11*f* of the collision member 11 is 0.03×D4 in Example 1 and is 0.3×D4 in Example 4, wherein D4 represents the diameter of the collision member 11. The product of Example 1 has a smaller (better) average particle diameter and a sharper particle diameter distribution than the product of Example 4. However, the product of Example 4 has a smaller (better) average particle diameter and a sharper particle diameter distribution than the product of Comparative Example, which is prepared by the conventional pulverizer 100*a*. Therefore, it is confirmed that when the diameter D5 is from 0.03×D4 to 0.3×D4, the resultant products can have a smaller (better) average particle diameter and a sharper particle diameter distribution than conventional products.

In addition, in the pulverizer 100, the diameter D3 of the particle path controlling member 14 is larger than the inner diameter D2 of the nozzle throat 18, and the diameter D3 is 0.4×D1, 0.25×D1, and 0.6×D1 in Examples 1, 5 and 6, respectively, wherein D1 represents the inner diameter of the particle path controlling nozzle 8. The product of Example 1 has a smaller (better) average particle diameter and a sharper particle diameter distribution than the products of Examples 5 and 6. However, each of the products of Examples 5 and 6 has a smaller (better) average particle diameter and a sharper particle diameter distribution than the product of Comparative Example, which is prepared by the conventional pulverizer 100*a*. Therefore, it is confirmed that when the diameter D3 of the particle path controlling member 14 is from 0.25×D1 to 0.6×D1, the resultant products can have a smaller (better) average particle diameter and a sharper particle diameter distribution than conventional products.

Further, in the pulverizer 100, the distance L1 between the rear end of the particle path controlling member 14 and the nozzle throat 18 is 3.0×D2 in Example 1 and is 1.0×D2 in Example 7, wherein D2 represents the inner diameter of the nozzle throat 18. The product of Example 1 has a smaller (better) average particle diameter and a sharper particle diameter distribution than the product of Example 7. However, the product of Example 7 has a smaller (better) average particle diameter and a sharper particle diameter distribution than the product of Comparative Example, which is prepared by the conventional pulverizer 100*a*. Therefore, it is confirmed that when the distance L1 is from 1.0×D2 to 3.0×D2, the resultant products can have a smaller (better) average particle diameter and a sharper particle diameter distribution than conventional products.

In the pulverizer 100, the length L2 of the particle path controlling member 14 is 1.0×D3 in Example 1 and is 3.0×D3 in Example 8, wherein D3 represents the diameter of the particle path controlling member 14. The product of Example 1 has a smaller (better) average particle diameter and a sharper particle diameter distribution than the product of Example 8. However, the product of Example 8 has a smaller (better) average particle diameter and a sharper particle diameter distribution than the product of Comparative Example, which is prepared by the conventional pulverizer 100*a*. Therefore, it is confirmed that when the length L2 is from 1.0×D3 to 3.0×D3, the resultant products can have a smaller (better) average particle diameter and a sharper particle diameter distribution than conventional products.

In addition, in the pulverizer 100, the angle γ between the virtual center line C and the side surface 11*s* of the truncated cone portion 11*a* of the collision member 11 is 20° in Example 1 and is 10° in Example 9. The product of Example 1 has a smaller (better) average particle diameter and a sharper particle diameter distribution than the product of Example 9. However, the product of Example 9 has a smaller (better) average particle diameter and a sharper particle diameter distribution than the product of Comparative Example, which is prepared by the conventional pulverizer 100*a*. Therefore, it is confirmed that when the angle γ between the virtual center line C and the side surface 11*s* of the truncated cone portion 11*a* of the collision member 11 is from 10° to 20°, the resultant products can have a smaller (better) average particle diameter and a sharper particle diameter distribution than conventional products.

In the pulverizer used for Example 1, the particle path controlling member 14 has a cone-shaped projection 22 at the rear end portion thereof. In contrast, in the pulverizer used for Example 10, the particle path controlling member 14 does not have such a cone-shaped projection at the rear end portion thereof. The product of Example 1 has a smaller (better) average particle diameter and a sharper particle diameter distribution than the product of Example 10. Therefore, it is preferable to use, as the particle path controlling member 14, a particle path controlling member having a cone-shaped projection at the rear end thereof.

In the pulverizer 100, an opening such as the raw material inlet 9*b* illustrated in FIG. 6 is not formed on an inner surface of the accelerating tube 9, and therefore formation of a shock wave is prevented, resulting in prevention of occurrence of the problems caused by a shock wave.

The pulverizer illustrated in FIG. 1 uses the high pressure ejector 2 as a raw material feeder to feed a raw material to the solid-gas mixer 4. By using such a high pressure ejector, the pressure in the solid-gas mixer 4 can be easily increased to a pressure sufficient for pulverizing a raw material.

The pulverizer illustrated in FIG. 5 uses the high pressure screw feeder 101 as a raw material feeder to feed a raw material to the solid-gas mixer 4. By using such a high pressure screw feeder, a raw material can be quantitatively supplied to the solid-gas feeder 4, thereby preparing a pulverized material (product) with little variation.

In the solid-gas mixer 4 of the pulverizer 100 illustrated in FIG. 5, a compressed gas is fed in a direction perpendicular to the raw material feeding direction. By using such a solid-gas mixer, a raw material can be well dispersed in the compressed gas in the solid-gas mixer 4, and therefore particles of the raw material can be securely collided with proper portions of the collision member.

In addition, by providing a pressure controller (such as a combination of the pressure adjusting valve 5 and the pressure controller 6) to adjust the pressure of a gas, a compressed gas having a desired pressure can be supplied to the particle path controlling nozzle 8, thereby ejecting the solid-gas mixture at a desired velocity from the ejection opening of the accelerating tube 9. Therefore, a raw material can be collided with the collision member 11 at a desired velocity, thereby producing a product (i.e., a pulverized material) having a desired average particle diameter.

The pulverization method of the present invention relates to a pulverization method including mixing a raw material and a compressed gas to prepare a solid-gas mixture; feeding the solid-gas mixture to a particle path controlling nozzle to accelerate the solid-gas mixture while controlling flow paths of particles of the raw material so as to choose different flow paths based on particle diameters of the particles of the raw material; further accelerating the accelerated solid-gas mixture in an accelerating tube while maintaining the flow paths of the particles; and ejecting the accelerated solid-gas mixture from the accelerating tube toward a collision member to pulverize the raw material.

By using this pulverization method, formation of a shock wave can be prevented, thereby making it possible to collide particles of a raw material with proper portions of a collision member, resulting in increase of the pulverization efficiency and production of a product at a high yield.

The toner production method of the present invention is used for producing a toner having a desired average particle diameter by pulverizing a raw material (raw toner) having an average particle diameter larger than the desired average particle diameter of the toner. The toner production method uses the pulverization method and the pulverizer 100 of the present invention. By using the toner production method, a toner having the desired average particle diameter can be produced at a high yield with high pulverization efficiency.

Since the toner of the present invention is prepared by the toner production method of the present invention using the pulverizer of the present invention, the toner has a smaller average particle diameter and a sharper particle diameter distribution than toners prepared by conventional pulverization methods.

Additional modifications and variations of the present invention are possible in light of the above teachings. It is therefore to be understood that within the scope of the appended claims the invention may be practiced other than as specifically described herein.

What is claimed is:

1. A pulverizer comprising:

a solid-gas mixer to mix a compressed gas and particles of a raw material to be pulverized to prepare a solid-gas mixture;

a particle path controlling nozzle connected with the solid-gas mixer to feed the solid-gas mixture fed from the solid-gas mixer while accelerating the solid-gas mixture and controlling the particles of the raw material so as to choose different flow paths based on particle diameters of the particles of the raw material;

a collision member; and an accelerating tube connected with the particle path controlling nozzle to further accelerate the solid-gas mixture fed from the particle path controlling nozzle while maintaining the flow paths of the particles and ejecting the accelerated solid-gas mixture toward the collision member to pulverize the raw material.

2. The pulverizer according to claim 1, wherein the particle path controlling nozzle includes:

a throat surface at a rear end thereof, whose diameter decreases in a flowing direction of the solid-gas mixture; and a particle path controlling member to control the particles of the raw material so as to flow toward the throat surface and choose different flow paths in the particle path controlling nozzle and the accelerating tube based on particle diameters of the particles of the raw material.

3. The pulverizer according to claim 2, wherein a nozzle throat angle formed by the throat surface and a virtual center line of the particle path controlling nozzle is from 30° to 80°.

4. The pulverizer according to claim 2, wherein the accelerating tube is a Laval nozzle, which has an inner surface whose diameter continuously increases in the flowing direction of the solid-gas mixture, and wherein a Laval angle formed by the inner surface of the accelerating tube and a virtual center line of the accelerating tube is from 2.5° to 4.0°.

5. The pulverizer according to claim 2, wherein the collision member has a truncated cone portion having a flat surface on a front end thereof, and wherein a diameter of the flat surface is from 0.03×D4 to 0.3×D4, wherein D4 represents an outer diameter of the collision member.

6. The pulverizer according to claim 2, wherein the particle path controlling member has a diameter greater than a diameter of a nozzle throat, which is an end of the throat surface and which is connected with the accelerating tube, and wherein the diameter of the particle path controlling member is from 0.25×D1 to 0.60×D1, wherein D1 represents an inner diameter of a portion of the particle path controlling nozzle located on an upstream side from the particle path controlling member relative to the flowing direction of the solid-gas mixture.

7. The pulverizer according to claim 2, wherein a distance between a rear end of the particle path controlling member relative to the flowing direction of the solid-gas mixture and a nozzle throat, which is an end of the throat surface and which is connected with the accelerating tube, is from 1.0×D2 to 3.0×D2, wherein D2 represents an inner diameter of the nozzle throat.

8. The pulverizer according to claim 2, wherein a length of the particle path controlling member in the flowing direction of the solid-gas mixture is from 1.0×D3 to 3.0×D3, wherein D3 represents an outer diameter of the particle path controlling member.

9. The pulverizer according to claim 2, wherein the collision member has a truncated cone portion having a flat surface on a front end thereof, and wherein an angle formed by a side surface of the truncated cone portion and a virtual center line of a flow path of the solid-gas mixture from the accelerating tube toward the collision member is 10° to 20°.

10. The pulverizer according to claim 2, wherein the particle path controlling member has a cone-shaped projection at a rear end thereof in the flowing direction of the solid-gas mixture.

11. The pulverizer according to claim 1, wherein the accelerating tube has no opening on an inner surface of a tubular portion thereof located between a nozzle throat, at which the accelerating tube is connected with the particle path controlling nozzle, and an ejection opening of the accelerating tube, from which the solid-gas mixture is ejected toward the collision member.

12. The pulverizer according to claim 1, further comprising:

a raw material supplier to supply the raw material to the solid-gas mixer, wherein the raw material supplier includes an ejector.

13. The pulverizer according to claim 1, further comprising:

a raw material supplier to supply the raw material to the solid-gas mixer, wherein the raw material supplier includes a screw feeder, in which a pressure substantially equal to a pressure of the compressed gas is applied.

14. The pulverizer according to claim 1, wherein the compressed gas is fed into the solid-gas mixer from a direction substantially perpendicular to a traveling direction of the raw material in the solid-gas mixer.

15. The pulverizer according to claim 1, further comprising:

a pressure controller to control a pressure in the solid-gas mixer.

* * * * *